United States Patent [19]

Bleeck

[11] 4,067,180

[45] Jan. 10, 1978

[54] BOBBIN HOLDER ARRANGEMENT FOR A DOUBLE TWIST THREAD TWISTING SPINDLE

[75] Inventor: Heinz Bleeck, Probstried, Germany

[73] Assignee: Saurer-Allma GmbH, Allgauer Maschinenbau, Kempten, Germany

[21] Appl. No.: 726,916

[22] Filed: Sept. 27, 1976

[30] Foreign Application Priority Data

Oct. 6, 1975 Germany ..... 7531686[U]

[51] Int. Cl.[2] ..... D01H 7/86

[52] U.S. Cl. ..... 57/58.52; 57/58.83; 57/58.86

[58] Field of Search ..... 57/58.49, 58.52, 58.83, 57/58.86, 106; 242/118.1, 118.11, 118.41, 118.61

[56] References Cited

U.S. PATENT DOCUMENTS

| | | | |
|---|---|---|---|
| 3,018,604 | 1/1962 | Lenk | 57/58.86 X |
| 3,022,623 | 2/1962 | Lenk | 57/58.86 X |
| 3,119,224 | 1/1964 | Kocks | 57/58.52 |
| 3,552,693 | 1/1971 | Scherf | 57/58.52 X |
| 3,717,989 | 2/1973 | Heimann et al. | 57/58.52 |

*Primary Examiner*—John Petrakes

*Attorney, Agent, or Firm*—Blanchard, Flynn, Thiel, Boutell & Tanis

[57] ABSTRACT

A bobbin holder arrangement having an open top stationary bobbin box with a first bobbin carrier removably mounted therein for supporting a first thread carrying bobbin thereon. A rotary flyer is rotatably secured to the first bobbin carrier and is removable therewith and has a thread guide thereon for guiding a thread from the first bobbin. A second bobbin carrier is releasably mounted on the first bobbin carrier for supporting a second thread carrying bobbin thereon and above the rotary flyer. The thread guide on the rotary flyer is located at a location which is greater in diameter than the maximum diameter of the second bobbin so that the thread on the first bobbin is unwound therefrom through the thread guide on the rotary flyer and is held in spaced relation from the periphery of the thread wound on the second bobbin.

11 Claims, 1 Drawing Figure

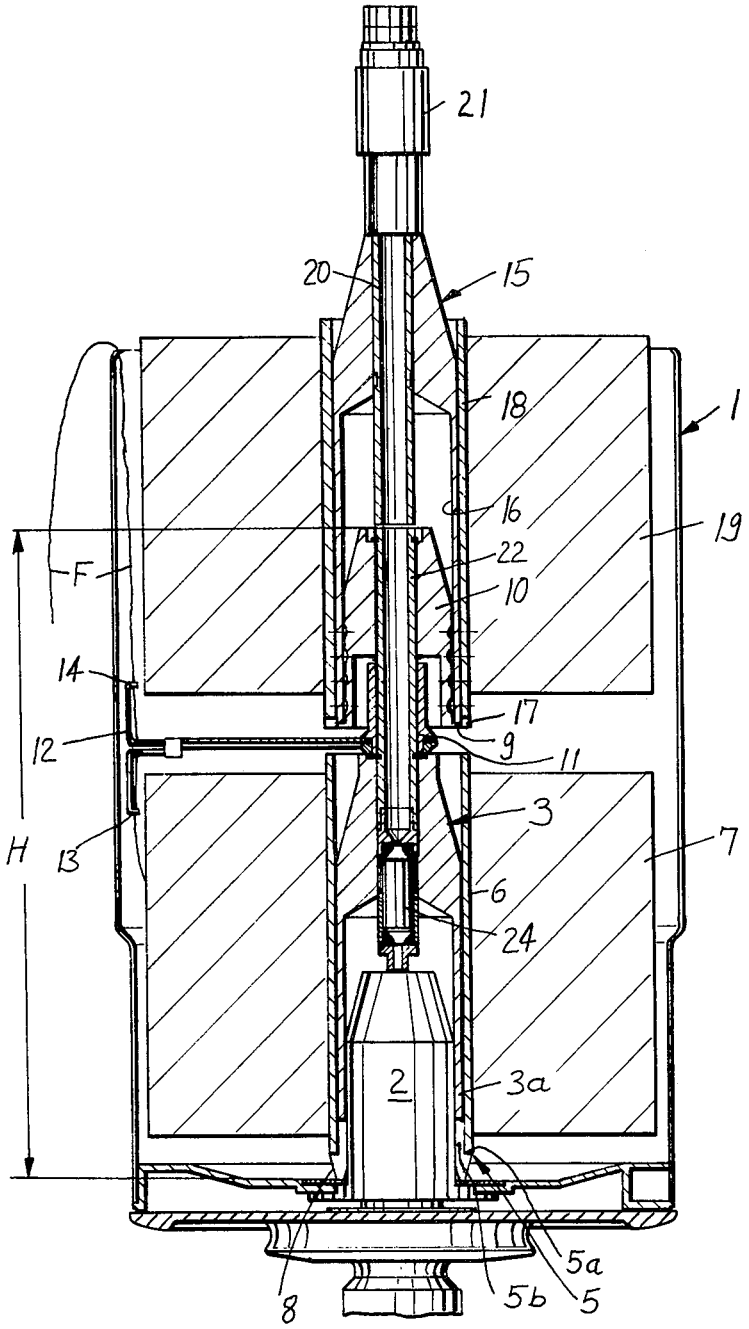
21
20
15
18
1
16
19
22
F
10
14
17
12
9
11
3
H
13
7
6
24
2
3a
5a
8
5b
5

BOBBIN HOLDER ARRANGEMENT FOR A DOUBLE TWIST THREAD TWISTING SPINDLE

FIELD OF THE INVENTION

The invention relates to a bobbin holder arrangement for a double twist thread twisting spindle, in which the individual threads to be twisted together are drawn overhead from two supply bobbins located one above the other in the stationary bobbin box, there being provided between the two bobbins a rotatable flyer the working diameter of which is larger than the diameter of the upper supply bobbin.

BACKGROUND OF THE INVENTION

In a known bobbin holder arrangement of this type (from German Offenlegungsschrift 1 510 855) the lower bobbin is placed on a conical pin of the bobbin box. The conical pin has at its upper end an opening in which a thread guide tube can be inserted. This thread guide tube has a plate for supporting the upper bobbin, and beneath the plate a mounting for the thread twisting flyer. This known bobbin holder arrangement has various disadvantages. The supply bobbins have to be of as large diameter as possible in relation to the bobbin box surrounding them, so that only a small space is available between the supply bobbin and the internal wall of the bobbin box. Furthermore, large supply bobbins are of considerable weight, of about 2.5 kg. Owing to the short space between supply bobbin and bobbin box it is extremely difficult to insert the lower supply bobbin itself into the bobbin box. Moreover, the thread drawn from the lower supply bobbin has to be drawn through the guide eye or eyes of the flyer. This is in itself not possible, however, owing to the reduced space in the spool box, it must therefore be effected externally of the bobbin box. The attendant has to hold the outside of the second bobbin already located on the plate of the thread guide tube and then draw the thread through the flyer. However, owing to the considerable weight of large supply bobbins this mode of working is impossible so that in the first place only the thread guide tube with the flyer located thereon can be inserted in the pin after the threading of the thread coming from the lower supply bobbin and then the upper supply bobbin can be slipped over the thread guide tube and located on the plate thereof. The supply bobbins and the individual parts of the bobbin holder arrangement must therefore be inserted into the bobbin box one after the other in a laborious manner. Also the known bobbin holder device has the disadvantage that the thread guide tube, owing to the flyer provided on its underside together with a supply bobbin located on it can never be removed, since otherwise damage of the flyer is likely and also the whole unit tips over.

A bobbin holder arrangement for a double twist thread twisting spindle is also known (from German Patent Specification No. 1 560 257), which includes a hollow cylindrical receiver which can be freely and withdrawably inserted in the bobbin box, on which the sleeves of the supply bobbins that form a unit with one another can be mounted and which includes an axial holder for the lower sleeve. This known bobbin holder arrangement is however unsuitable for large supply bobbins, since it does not have a flyer which is absolutely essential in the case of large supply bobbins. Moreover, in the case of large supply bobbins, the receiver with the supply bobbins located thereon, which together have a weight of about 5 kg., is of too great height and of too high weight, so that much more space must be provided above the bobbin box in order to enable the whole unit to be inserted into the bobbin box.

The invention is based on the problem of providing a bobbin holder arrangement for double twist thread twisting spindles of the type referred to initially, which whilst avoiding the above-mentioned disadvantages makes possible rapid and convenient insertion of large supply bobbins with a minimum of manual operations.

The bobbin holder arrangement according to the invention is characterised by a first hollow insert for receiving the lower supply bobbin which is freely and withdrawably insertable into the bobbin box, which has at its lower end a resiliently compressible first supporting device engaging the lower rim of the bobbin sleeve, at its upper region a second supporting device for a second hollow insert which can be mounted on the first member and carries the upper bobbin, a knob arranged above the second supporting device and below it a mounting for the flyer, the said first member extending at most only as far as half the height of the upper supply bobbin.

Owing to the resiliently compressible first supporting device the first insert can be inserted from above into the bobbin sleeve of the lower supply bobbin, which takes place outside the bobbin box. After the lower insert has been inserted into the bobbin sleeve, its resiliently compressible supporting device expands and supports the lower rim of the bobbin sleeve. Outside the bobbin box the thread drawn from the lower supply bobbin can be drawn into the guide eyes of the flyer connected to the first insert. This unit consisting of insert, flyer and lower supply bobbin can then be engaged by the knob and conveniently inserted into the bobbin box, only a little space needing to be available between the supply bobbin and the bobbin box. Since the lower insert extends at most only as far as half the height of the upper supply bobbin, only a relatively free height needs to be available above the upper rim of the bobbin box for the insertion of this unit. For the supper supply bobbin a second insert is likewise provided on which the upper supply bobbin can be located outside the frame. Since this second insert may be flat on its underside and also has no flyer there, this second insert can, like the first insert, be set down together with the bobbin on a flat surface.

BRIEF DESCRIPTION OF THE DRAWING

The invention will be explained below in more detail with reference to a practical example illustrated in the drawing.

DETAILED DESCRIPTION

In the drawing, at 1 is indicated the bobbin box of a double twist twisting spindle which has a pin 2 tapering conically upwards. On this pin 2 is located a lower insert 3. This insert 3 has at its lower end a first carrier device 5 for the lower edge of the bobbin sleeve 6 of the lower supply bobbin 7. This first carrier device 5 is resiliently compressible. For this purpose the lower part 3*a* of the insert preferably consists of resiliently yieldable material, such for example as synthetic resin. The carrier device 5 includes a flange 5*a* supporting the lower rim of the bobbin sleeve 6 and a plurality of axial slots 5*b* provided in the insert in the region of this flange 5*a*. Owing to these axial slots the lower end of the insert 3 can be resiliently compressed upon insertion into the bobbin box 6 from above. In order further to facilitate this insertion and compression, the part of the first insert 3 below the flange 5*a* preferably tapers conically towards the free lower end, the smallest diameter of this cone being somewhat smaller than the upper diameter of the bobbin sleeve 6. If this bobbin sleeve is cylindrical, as is the case in the practical example illustrated, the upper internal diameter of course corresponds to the lower internal diameter.

In its upper region the first insert 3 has a second carrier device 9 formed by a flange and a knob or head 10 provided above the carrier device. Beneath the flange 9 is provided a bearing 11 for the flyer 12, which together with the lower insertion member 3 thus forms a unit. The flyer has two guide eyes 13 and 14. The flange 9 and the head 10 preferably consist of one piece. The knob 10 is here cylindrical where it adjoins the flange 9 and thus forms a centering means for a second hollow insert 15 which at its lower end has a cylindrical recess 16 matching the knob 10. In the axial direction the second insert 15 is supported on the flange 9. The second insert 15 has at its lower end a flange 17 which serves to support the bobbin sleeve 18 of the upper supply bobbin 19. This may also be placed, externally of the machine, on the insert 15 from above.

The second insert 15 has a thread guide tube 20 and a thread brake 21. The thread guide tube 20 is coaxial with a thread guide tube 22 provided in the first insert 3 and extends into close contact with this thread guide tube. In the first insert 3 a thread brake 24 may be provided.

The thread brake 21 provided on the second insert 15 is of such construction that it may at the same time serve as a head.

Prior to the insertion of the supply bobbins 7 and 19, these are assembled with their inserts outside the machine. For this purpose the insert 3 is slid from above into the bobbin sleeve 6, its carrier device 5 being resiliently compressed. However, as soon as the flange 5*a* emerges again from the lower end of the bobbin sleeve 6 the flange expands again into its normal position and forms a support for the bobbin sleeve 6. The thread F drawn from the supply bobbin 7 is then drawn through the two guide eyes 13 and 14 of the flyer 12, so that it still projects to a considerable extent out of the upper guide eye 14. The unit consisting of insert 3, flyer 12 and lower supply bobbin 7 may now be conveniently engaged by the knob 10 and inserted into the bobbin box 1. Since it is of a height which is less than the overall height of the two superimposed supply bobbins 7 and 19, there needs to be, above the bobbin box 1, only a free height that corresponds to the height H of this unit. Outside the frame the supply bobbin 19 can then be slid from above on to the second insert 15. This second unit can then be engaged by the thread brake 21 formed like a head and placed on the first unit. The head 10 centers the insert 15.

The embodiments of the invention in which an exclusive property or privilege is claimed are defined as follows:

1. A bobbin holder arrangement, comprising:

an open top stationary bobbin box having first bobbin carrier means removably mounted therein for supporting a first thread carrying bobbin thereon;

rotary flyer means rotatably secured to said first bobbin carrier means and removable therewith and having thread guide means thereon for guiding a thread from said first bobbin; and second bobbin carrier means releasably mounted on said first bobbin carrier means for supporting a second thread carrying bobbin thereon and above said rotaty flyer means, said thread guide means on said rotary flyer means being located at a location greater in diameter than the maximum diameter of said second bobbin whereby said thread on said first bobbin is unwound therefrom through said thread guide means on said rotary flyer means and being held in spaced relation from the periphery of said thread wound on said second bobbin.

2. The bobbin arrangement according to claim 1, wherein said first and second bobbin carrier means have a combined height less than the height of said stationary box but greater than one-half the height thereof.

3. The bobbin arrangement according to claim 1, wherein said first bobbin carrier means includes an elastically compressible support device and an enlarged knob at the upper end thereof; and wherein said second bobbin carrier means includes an insert member having a recess therein receiving said knob therein to form a support for said insert member and said second bobbin.

4. A bobbin holder arrangement according to claim 3, wherein at the lower end of said knob a flange is provided for supporting said insert member.

5. A bobbin holder arrangement according to claim 4, wherein said knob is of cylindrical construction where it adjoins said flange and is centered in said cylindrical recess at the lower end of said insert member.

6. A bobbin holder arrangement according to claim 1, wherein said first bobbin carrier means consists in its lower part of resiliently yieldable material, has at its lower end a flange for supporting a bobbin sleeve on said first bobbin, and in the region of said flange having a plurality of axial slots therein.

7. A bobbin holder arrangement according to claim 6, wherein said first bobbin carrier means includes a portion adjacent the free end thereof which tapers conically towards its free lower end, the smallest diameter of said conical portion being somewhat smaller than the upper internal diameter of said bobbin sleeve.

8. A bobbin holder arrangement according to claim 1, wherein said bobbin carrier means includes a thread guide tube and a thread brake arranged in the tube.

9. A bobbin holder arrangement according to claim 8, wherein said second bobbin carrier means has at its lower end a flange for supporting the lower rim of an upper bobbin sleeve on said second bobbin.

10. A bobbin holder arrangement according to claim 9, wherein said second bobbin carrier means has a thread guide tube which is arranged coaxially with said thread guide tube and extends tightly against it.

11. A bobbin holder arrangement according to claim 1, wherein there is arranged at the upper end of the second bobbin carrier means a thread brake which is constructed as a knob.

* * * * *